US005979597A

United States Patent [19]

Grolier

[11] Patent Number: 5,979,597

[45] Date of Patent: Nov. 9, 1999

[54] SUCTION SILENCER SYSTEM FOR A REFRIGERATION COMPRESSOR

[75] Inventor: Patrice Grolier, Lyons, France

[73] Assignee: Tecumseh Europe S.A., La Verpilliere, France

[21] Appl. No.: 09/147,059

[22] PCT Filed: Mar. 25, 1997

[86] PCT No.: PCT/FR97/00525

§ 371 Date: Sep. 29, 1998

§ 102(e) Date: Sep. 29, 1998

[87] PCT Pub. No.: WO97/37130

PCT Pub. Date: Oct. 9, 1997

[30] Foreign Application Priority Data

Mar. 29, 1996 [FR] France ..... 96 03988

[51] Int. Cl.[6] ..... F01N 1/08

[52] U.S. Cl. ..... 181/269; 181/229; 181/403

[58] Field of Search ..... 181/229, 403, 181/225, 269, 272, 282; 417/312

[56] References Cited

U.S. PATENT DOCUMENTS

| | | | |
|---|---|---|---|
| 3,396,907 | 8/1968 | Valbjorn | 181/229 |
| 4,111,278 | 9/1978 | Bergman | 181/403 |
| 4,370,104 | 1/1983 | Nelson et al. | 181/403 |

*Primary Examiner*—Khanh Dang
*Attorney, Agent, or Firm*—Oblon, Spivak, McClelland, Maier & Neustadt, P.C.

[57] ABSTRACT

An inlet silencer system for a refrigeration motor-compressor set. An inlet silencer is formed by a casing separated by a wall into two chambers which are coupled to each other by a coupling tube. A lid bearing an intake tube introduces refrigerant gas into the first chamber and a lead-in pipe connects the second chamber to the suction part of the cylinder head. The ratio by volume between the two chambers is in the order of 1. This ratio is determined to obtain a diminishing of the acoustic energy in the range of a frequency of 500 Hz. Furthermore, a chamber which is parallel connected on the suction path is used as a resonator to improve the attenuation and the acoustic spectrum. This device can be used on low-power, hermetically sealed, single-cylinder, alternating motor-compressor sets.

20 Claims, 4 Drawing Sheets

SUCTION SILENCER SYSTEM FOR A REFRIGERATION COMPRESSOR

BACKGROUND OF THE INVENTION

The present invention relates to an inlet silencer system for a refrigeration motor-compressor set.

DISCUSSION OF THE BACKGROUND

Refrigeration motor-compressor sets are well known devices generally having, within a hermetically sealed capsule, a motor driving a compressor. The motor-compressor set is connected in a tightly sealed manner to the refrigeration circuit and the compressor is therefore submerged in the refrigerant gas within the capsule.

The compression is generally of the alternating type and therefore has a piston that moves within a cylinder and is actuated by the motor. The refrigerant gas is sucked into the capsule, compressed in the cylinder and then sent back to the refrigeration circuit.

Motor-compressor sets radiate a non-negligible amount of acoustic energy firstly because of the mechanical vibrations generated and secondly because of the noise, especially the suction noise, generated by the flow of gas.

This acoustic energy is inconvenient, especially for household applications.

In known systems, it has been attempted to reduce the nuisance caused by this sound level through various devices that lessen the vibrations and through silencers that lessen the gas flow noises. These silencers may, for example, be formed by chambers into which the refrigerant gas flows at the inlet and the outlet of the compressor. These chambers have volumes and inlet and outlet conduit sections that are determined to obtain the greatest possible attenuation of the band of audible frequencies.

Thus, the U.S. Pat. No. 3,396,907 describes a system where one or more chambers are series-connected with the crank-case of the crankshaft/connecting-rod assembly, which is itself connected by a tube to the suction chamber of the compressor.

The British patent No. 1,043,888 for its part describes a back-flow silencer system for compressors. This silencer has two unequal chambers in series on the back-flow tube of the compressor, these chambers being obtained by means of sheets that are folded and joined by welding.

However, none of the approaches known to date enables satisfactory attenuation and, in particular, it can be seen that suction noises remain and are the source of noise at a level that is as yet far too high, especially in a frequency band around 500 Hz.

SUMMARY OF THE INVENTION

An object of the present invention therefore is an inlet silencer system that considerably improves the reduction of the suction noises in a motor-compressor set.

According to a first aspect of the invention, there is provided an inlet silencer system for motor-compressor sets of the type comprising, in a hermetically sealed capsule, a compressor comprising a body, within which there are positioned a cylinder containing a piston and at least one back-flow chamber, a motor for the driving of said piston and a cylinder head closing said cylinder frontally through a set of valves, said silencer system comprising at least one inlet silencer conveying the refrigerant gas to be compressed from within the capsule towards the cylinder head and comprising two chambers separated by a wall, an intake tube conveying the gas from within the capsule towards a first of said chambers, a coupling tube going through said wall to provide for the passage of the gas from the first chamber to the second chamber and a lead-in pipe connecting the second chamber to said cylinder head, said silencer system being characterised in that the ratio by volume between the two chambers is of the order of 1 and is determined to obtain a diminishing of acoustic energy in the region of a frequency of 500 Hz and in that the total volume of the two chambers is in the range of 7 to 11 times the cubic capacity of the compressor.

According to another aspect of the invention, said silencer system is also characterised in that it furthermore comprises an additional chamber serving as a resonator, parallel-connected on the suction path of the refrigerant gas.

Through these arrangements and other particular features that shall be described here below, a substantial improvement is obtained in the sound level with, in particular, high attenuation in the characteristic band of the compressor.

BRIEF DESCRIPTION OF THE DRAWINGS

The invention will be understood more clearly and other features and advantages shall appear from the following description and from the appended drawings of which.

DETAILED DESCRIPTION OF THE PREFERRED EMBODIMENTS

There are very many variants of refrigeration motor-compressor sets but most of them have a certain number of common characteristics.

Figure 1:
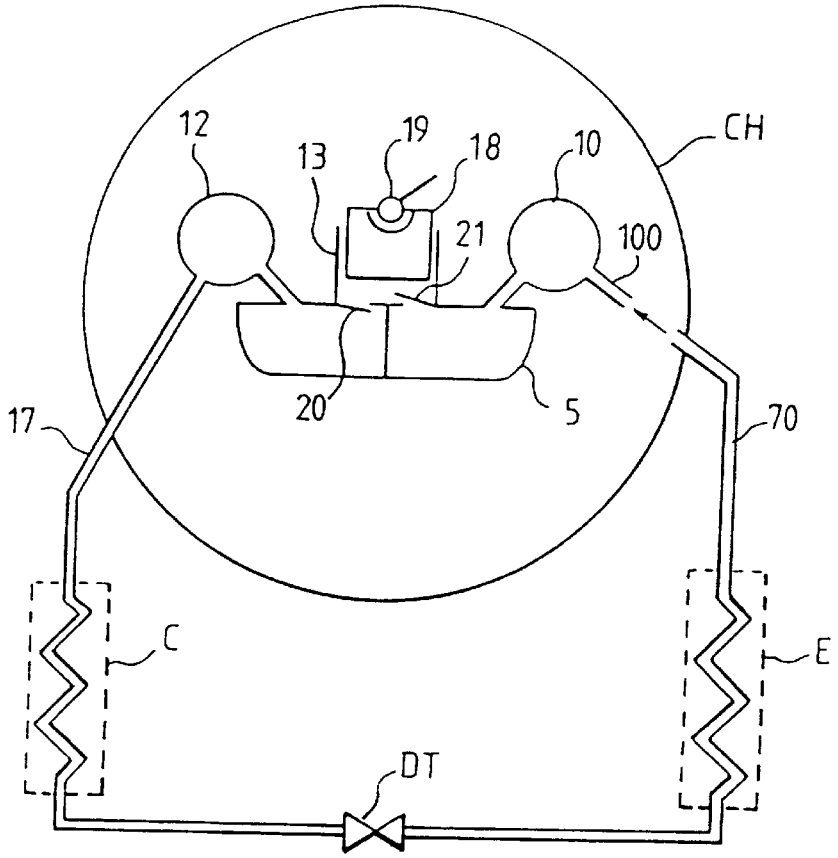
FIG.1 PRIOR ART
FIG. 1 is a very simplified drawing of a refrigeration system with a known type of motor-compressor set.

FIG. 1 is a very simplified drawing of a known system. The refrigeration circuit has in principle a compressor in a hermetically sealed capsule CH, a condenser C, a pressure-reducing valve DT and an evaporator E. The refrigerant gas coming from the evaporator is introduced into the capsule CH by the conduit 70.

The compressor positioned within the capsule CH has a piston 18 moving within a cylinder 13 actuated by an electrical motor by means of a rod 19. The cylinder is closed in front by a cylinder head 5 by means of a set of valves 20, 21. In the compressor shown, the refrigerant gas is sucked out of the capsule CH through an inlet silencer, comprising a chamber 10 and a loading tube 100 and connected to the suction part of the cylinder head 5. After passing through a suction valve 21, the gas is compressed and sent back to a back-flow silencer through a back-flow valve 20 and the back-flow part of the cylinder head 5. The back-flow silencer includes a chamber 12 neighbouring the chamber 10. The compressed gas is sent back to the condenser C by a conduit 17 going through the wall of the capsule CH.

A motor-compressor set of this kind already makes it possible to obtain a reduced level of sound. However, excessively high amplitudes are still noted in the main frequency band which is centred for example on 500 Hz for the compressor considered.

An aim of the invention therefore is an optimised silencer system that can be used to obtain high attenuation in the main frequency band. In addition, the invention is aimed at placing the cut-off frequency outside the range of energy harmonics of the suction pulse spectrum in order to obtain maximum attenuation.

Figure 2:
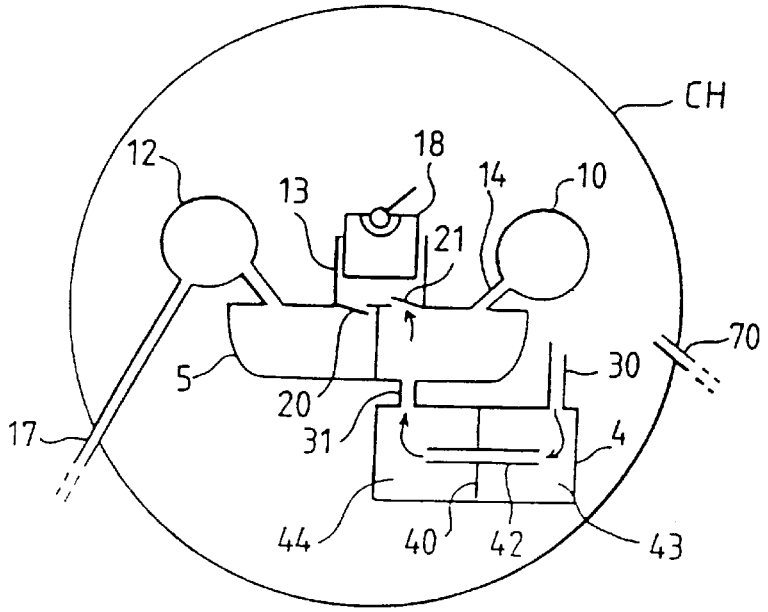
FIG. 2 is a drawing of a motor-compressor set with an inlet silencer system according to the invention.

FIG. 2 is a drawing of the motor-compressor set of FIG. 1 with an inlet silencer system according to the invention. The same reference numbers designate the same elements in the different figures. This system is based firstly on a concept of the use of two coupled chambers. There is therefore provided a silencer with a casing 4 that is divided into two chambers 43 and 44 by a wall 40, these chambers being coupled by means of a coupling tube 42 going through the wall 40. The gas is sucked out by means of an intake tube 30 leading into the first chamber 43 and the second chamber 44 is connected to the suction part of the cylinder head 5 by a passage 31.

Secondly, to further improve the damping of noise, the chamber 10 is kept but is closed so that it acts as a resonator (of the Helmholtz resonator type).

The effect of the inlet silencer with two chambers essentially depends on the ratios between the volumes of the various chambers and the ratios between the section and length of the different conduits.

These different ratios have been defined by the present Applicant as a function of the compressor considered.

The ratio between the volumes of the chambers 43 and 44 is approximately equal to 1 and is preferably close to 0.9 while the total volume of the chamber 43 plus the chamber 44 is about 7 to 11 times the cubic capacity of the compressor.

Furthermore, the intake tube 30 must have a section Sch (in $mm^2$) and a length Lch (in mm) such that the ratio Lch/Sch has a numerical value of substantially 2 to 3 and the coupling tube 42 must have a section Sc and a length Lc such that the ratio Lc/Sc has a numerical value ranging substantially from 2 to 3.

Furthermore, the lengths of penetration of the coupling tube 42 into the two chambers also has an effect on the transfer function of the silencer and, preferably, the lengths of penetration $L_{43}$ or $L_{44}$ into a chamber 43 or 44 with a volume $V_{43}$ or $V_{44}$ can be chosen so that the ratios $V_{43}/L_{43}$ and $V_{44}/L_{44}$ have a numerical value substantially ranging from 0.5 to 0.9. $V_{43}$ and $V_{44}$ are the total volumes of the chambers, respectively 43 and 44, including the volume of the coupling tube 42 therein. In all the ratios mentioned in the description, the volumes are expressed in $cm^3$, the lengths in mm and the sections in $mm^2$.

Finally, it is preferable that the ratio of the sections of the intake tube 30 to the coupling tube 42 should be of the order of 0.6 and that the section of the passage 31 should be about 2 to 2.5 times greater than that of the coupling tube.

As mentioned further above, the lessening of the suction noises is further improved by the addition of a resonator parallel-connected to the suction path of the refrigerant gas. This enables an adjustable improvement of the acoustic spectrum obtained by playing on the volume of the resonator and the dimensions of the linking conduit.

According to a particularly advantageous embodiment, profitable use can be made of the presence of a silencer chamber such as the chamber 10, should it exist, by converting this chamber into a resonator by eliminating the inlet 100 (FIG. 1).

Preferably, the volume of the chamber 10 is chosen to be about 1 to 3 times the cubic capacity of the compressor. Furthermore, the ratio between the length Lcd and the section Scd of the conduit 14 has a numerical value ranging substantially between 0.6 and 0.8.

Finally, it must be noted that the intake tube 30 is positioned so as to be as close as possible to the outlet of the conduit 70 so as to enable better guidance towards the cylinder and prevent the heating of the gases in contact with the heated elements of the compressor (such as the motor, etc.).

Figure 3:
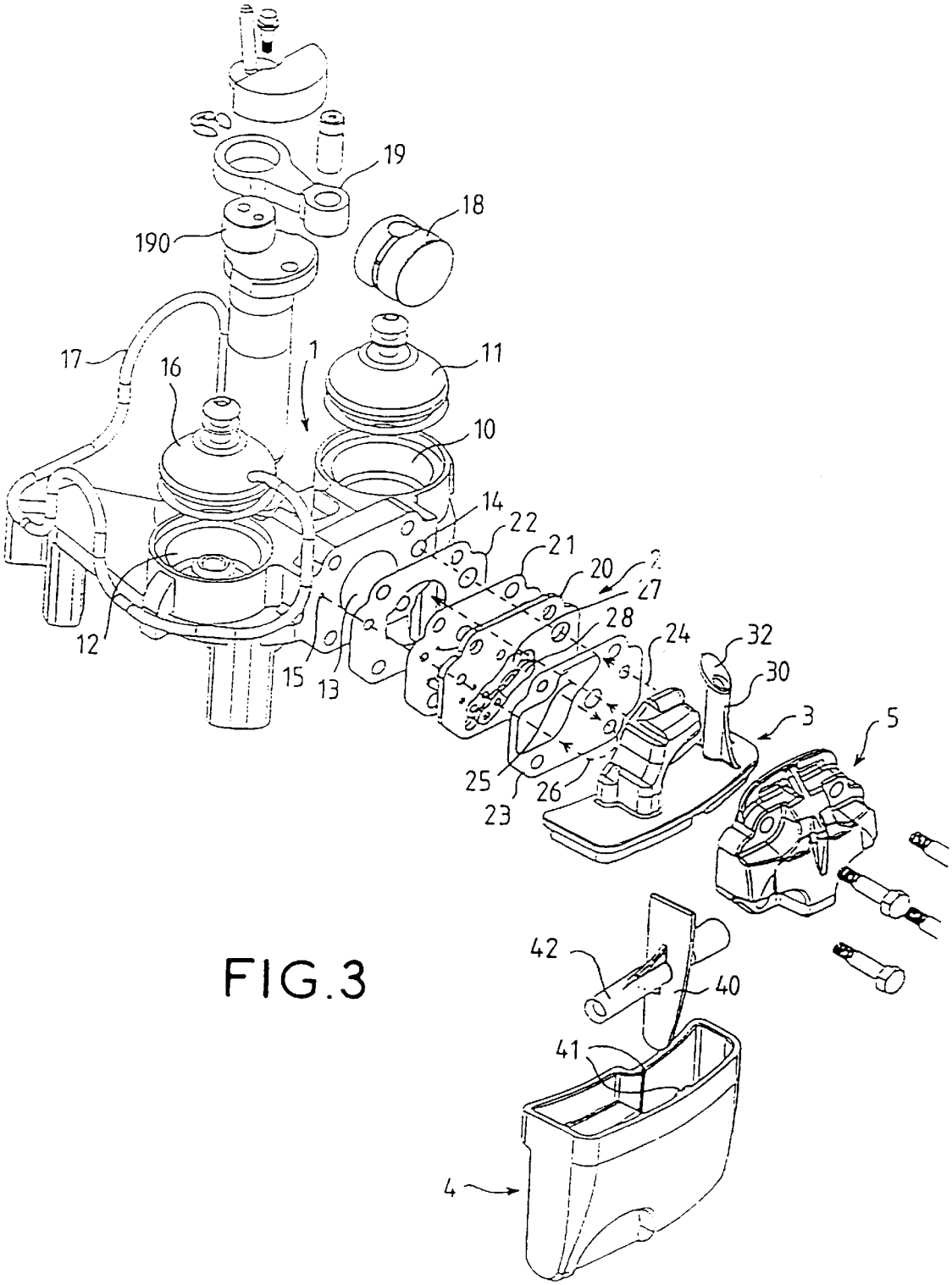
FIG. 3 is an exploded view of a part of the compressor and its inlet silencer according to the invention.

FIG. 3 shows a partial exploded view of an embodiment of a motor-compressor set according to the invention. The compressor has a body 1, for example made of cast iron, in which there are positioned a cylinder 13 whose axis is substantially horizontal in the figure, and two chambers 10, 12 with their closing caps 11, 16. The conduit 17 to the condenser starts from the cap 16. A motor (not shown) is mounted beneath the body so that, by means of a crank 190 and a rod 19, it drives the piston 18 which moves in the cylinder 13. The cylinder 13 is closed in front by a cylinder head 5 through a valve plate set 2. The cylinder head may be machined or moulded and in one example it is made of aluminium although this is not a restrictive option.

The valve plate set 2 has a suction valve 21 and a plate 20 bearing a back-flow valve 27 whose motion is limited by a clearance stop 28. The tight sealing in the assembly of the valve plate set 2 is ensured firstly by the seal 22 on the body 1, and secondly by the seal 23 on the cylinder head 5 and a lead-in pipe 31 of the silencer. The cylinder head 5 closes the entire unit, in covering the lead-in pipe 31. Dashes are used to show the paths of the gas. The path 25 is the suction path from the lead-in pipe to the cylinder, the path 26 is the back-flow path going from the cylinder to the cylinder head and then going back to the chamber 12 by the conduit 15, and the path 24 is the path between the resonator 10 and the cylinder head on the suction side going through the conduit 14. The silencer has a casing 4 divided into two chambers by means of a wall 40 bearing the coupling tube 42. The wall 40 is detachable and gets housed in slide grooves 41 of the casing 4. This greatly facilitates the mounting of the silencers on the compressor considered and the matching of the silencers with this compressor. The casing 4 is closed by a lid 3 bearing, on one side, the intake tube 30 connected to the chamber 43 (FIG. 2) and, on the other side, the lead-in pipe 31 which connects the second chamber 44 (FIG. 2) to the suction part of the cylinder head 5.

Preferably, the material chosen to make the cylinder 3, 4 is a thermoplastic material, for example a polybutylene terephthalate. The aim of this choice is to provide the fresh gases sucked in with greater insulation from the heat sources (in particular the motor).

It is important to maintain a suitable level of efficiency in the motor-compressor set. Indeed, by avoiding any considerable heating of gases sucked in, gases of the greatest possible density are obtained. Thus, for a given cubic capacity, more efficient filling of the cylinder is got through a greater mass flow rate. This gives increased refrigeration capacity for a given rate of operation One material that is particularly well suited to this application and is a material of the type indicated here above is the one known as VALOX (registered mark). With a thickness of at least 2.5 mm, the heat transfer losses are reduced by a factor of at least 100 as compared with cast iron and at least 1000 as compared with aluminium.

Figure 4:
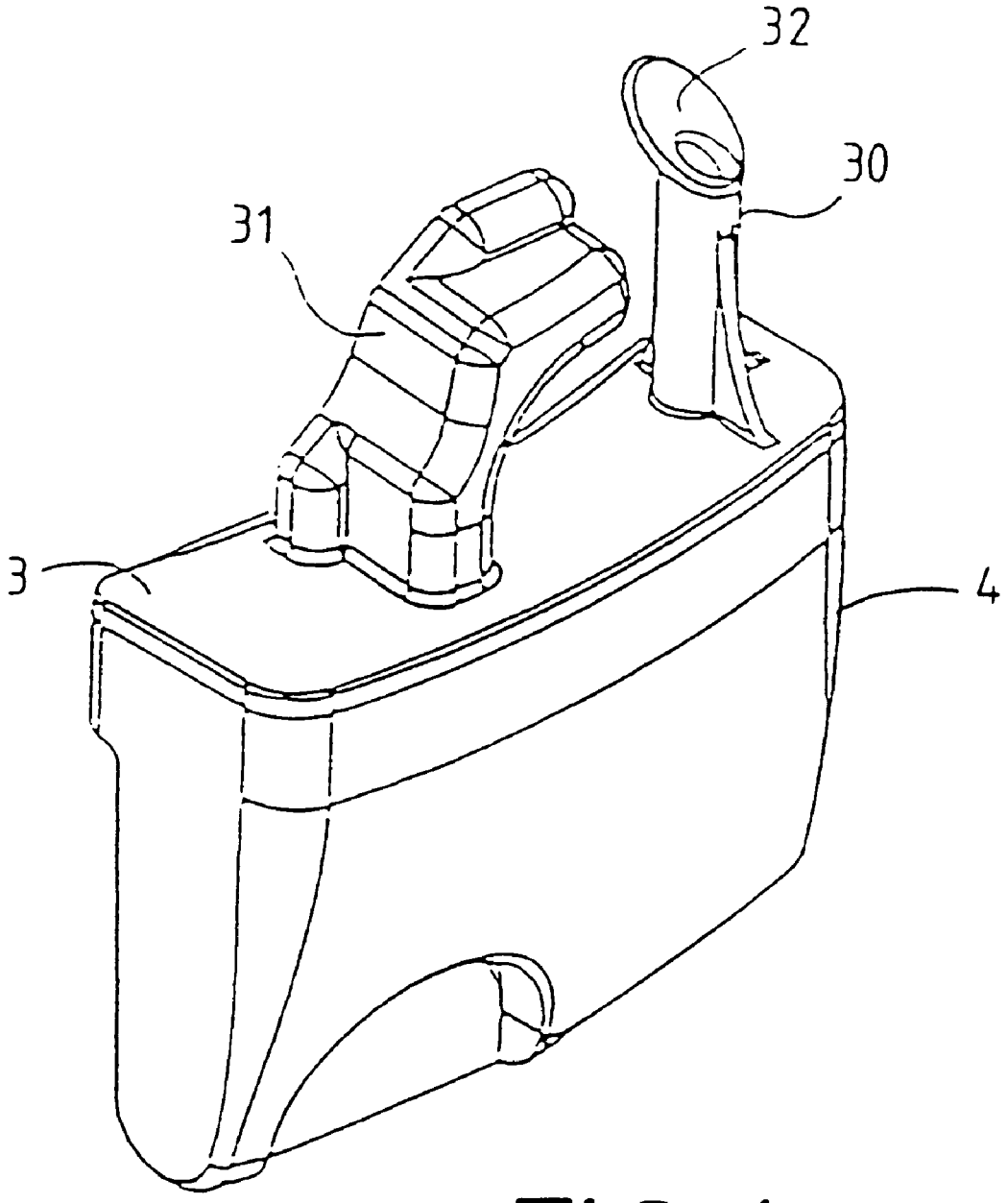
FIG. 4 shows the silencer according to the invention.

FIG. 4 shows the assembled silencer. The lid 3 and the casing 4 can be joined by bonding with a hot-polymerised epoxy bonder. The intake tube 30 has a flared-out inlet 32 in order to reduce the load losses. In the same way, for a similar reason, it is possible to provide for a convergent part at the inlet of the coupling tube 42 as shown in FIG. 3.

Figure 5:
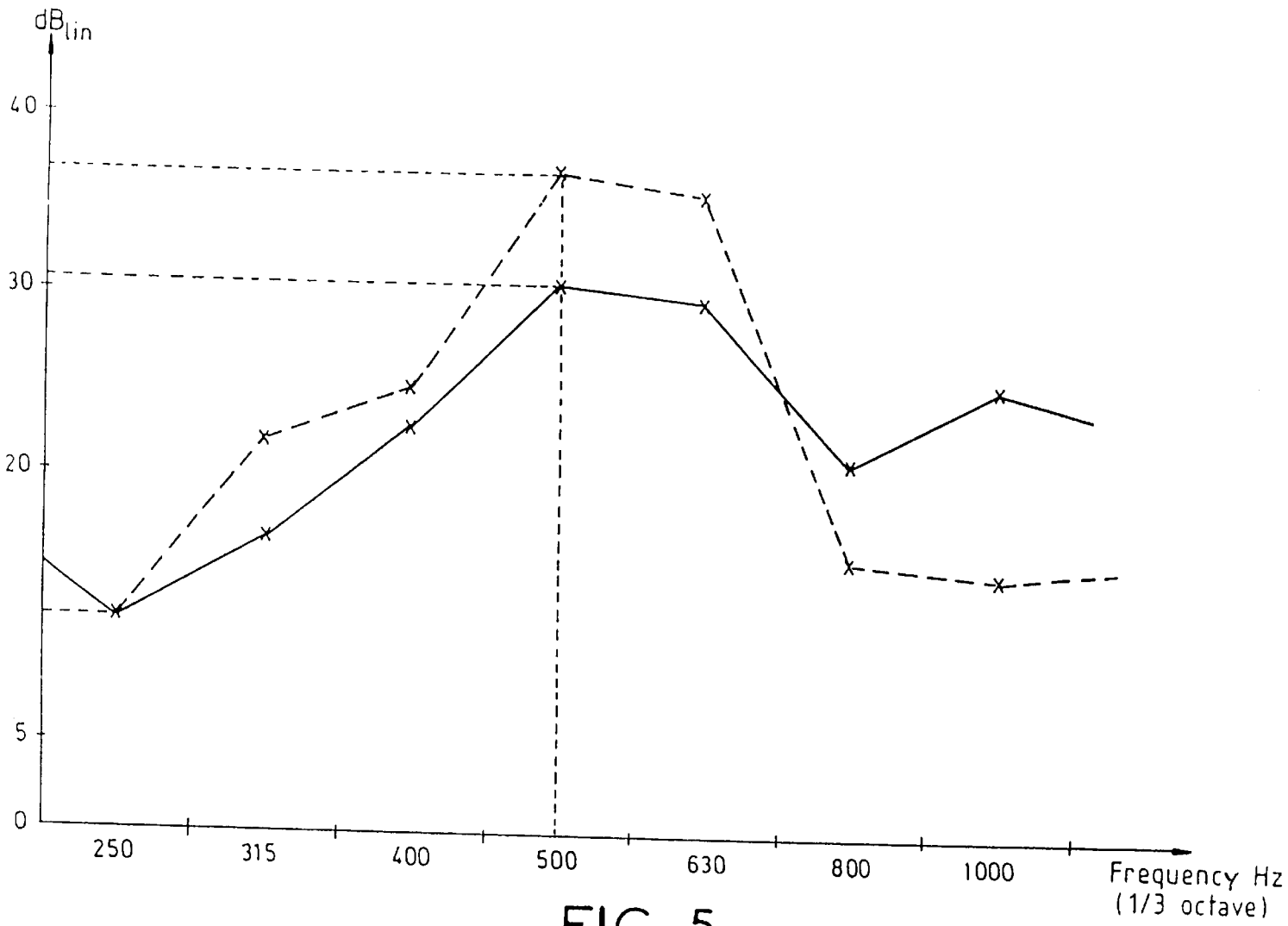
FIG. 5 is a graph showing the acoustic spectral curves for a standard configuration and a configuration according to the invention.

The silencer system according to the invention considerably improves the behaviour of the motor-compressor set as regards suction noises. FIG. 5 is a graph showing the acoustic spectrum in dashes for the configuration of the motor-compressor set of FIG. 1, made according to FIG. 3 but without silencers 3, 4 and with a suction chamber 10. The solid-line curve shows, under the same conditions, the acoustic spectrum for the motor-compressor set according to the invention of FIG. 3. In the 500 Hz one-third octave band, it can be seen that there is an improvement of more than 5 dBA without any notable or troublesome deterioration in the rest of the spectrum. This obviously results in considerable gain as regards the general acoustic level radiated.

Naturally, the invention is in no way limited to the particular embodiment that has been described.

I claim:

1. An inlet silencer system for motor-compressor sets of the type comprising, in a hermetically sealed capsule, a compressor comprising a body, within which there are positioned a cylinder containing a piston and at least one back-flow chamber, a motor for the driving of said piston and a cylinder head closing said cylinder frontally through a set of valves, said silencer system comprising at least one inlet silencer conveying the refrigerant gas to be compressed from within the capsule towards the cylinder head and comprising two chambers separated by a wall, an intake tube conveying the gas from within the capsule towards a first of said chambers, a coupling tube going through said wall to provide for the passage of the gas from the first chamber to the second chamber and a lead-in pipe connecting the second chamber to said cylinder head, said silencer system being characterised in that the ratio by volume between the two chambers is of the order of 1 and is determined to obtain a diminishing of acoustic energy in the region of a frequency of 500 Hz and in that the total volume of the two chambers is in the range of 7 to 11 times the cubic capacity of the compressor.

2. A silencer system according to claim 1, characterised in that the ratio of the volume of said first chamber to the volume of said second chamber is about 0.9.

3. A silencer system according to claim 1, characterised in that the intake tube has a section Sch and a length Lch such that the ratio Lch/Sch has a numerical value substantially ranging from 2 to 3.

4. A silencer system according to claim 1, characterised in that said coupling tube has a section Sc and a length Lc such that the ratio Lc/Sc has a numerical value substantially ranging from 2 to 3 and in that the lengths of penetration $L_{43}$ and $L_{44}$ of the coupling tube respectively into the first chamber and the second chamber are such that the ratio between the volume of a chamber and the length of penetration into this chamber, respectively $V_{43}/L_{43}$ and $V_{44}/L_{44}$, has a numerical value substantially ranging from 0.5 to 0.9.

5. A silencer system according to claim 4, characterised in that the ratio between the section Sch of the intake tube and the section Sc of the coupling tube is chosen to be of the order of 0.6.

6. A silencer system according to claim 5, characterised in that the lead-in pipe has a section about 2 to 2.5 times greater than that of the coupling tube.

7. A silencer system according to claim 1, characterised in that said silencer is made of a thermoplastic material.

8. A silencer system according to claim 7, characterised in that said material is a polybutylene terephtalate.

9. A silencer system according to one of the foregoing claims, characterised in that it furthermore comprises an additional chamber serving as a resonator, parallel-connected to the suction path of the refrigerant gas.

10. A silencer system according to claim 9, characterised in that said additional chamber is connected to the suction part of the cylinder head by a conduit.

11. A silencer system according to claim 10, characterised in that said additional chamber is a suction chamber positioned in said body and in that the linking conduit is made through the set of valves towards the cylinder head.

12. A silencer system according to claim 9, characterised in that the volume of said additional chamber is of the order of 1.1 to 1.3 times the cubic capacity of the compressor.

13. A silencer system according to claim 12, characterised in that said conduit has a length Lcd and a section Scd such that the section Lcd/Scd has a numerical value ranging substantially from 0.6 to 0.8.

14. A silencer system according to claim 1, characterised in that said coupling tube has an inlet with a shape that is convergent in said first chamber to reduce the load losses.

15. A silencer system according to claim 1, characterised in that said intake tube has a flared-out opening and is positioned in the vicinity of the gas inlet in the hermetically sealed capsule.

16. A silencer system according to claim 1, characterised in that said silencer comprises a housing divided into two chambers by a detachable wall and a lid bearing the intake tube and the lead-in pipe.

17. A silencer system according to claim 16, characterised in that said detachable wall with the coupling tube may be introduced and held in position in the housing by means of the slide grooves.

18. A silencer system according to claim 2, characterized in that the intake tube has a section Sch and a length Lch such that the ratio Lch/Sch has a numerical value substantially ranging from 2 to 3.

19. A silencer system according to claim 2, characterized in that said coupling tube has a section Sc and a length Lc such that the ratio Lc/Sc has a numerical value substantially ranging from 2 to 3 and in that the lengths of penetration $L_{43}$ and $L_{44}$ of the coupling tube respectively into the first chamber and the second chamber are such that the ratio between the volume of a chamber and the length of penetration into this chamber, respectively $V_{43}/L_{43}$ and $V_{44}/L_{44}$, has a numerical value substantially ranging from 0.5 to 0.9.

20. A silencer system according to claim 3, characterized in that said coupling tube has a section Sc and a length Lc such that the ratio Lc/Sc has a numerical value substantially ranging from 2 to 3 and in that the lengths of penetration $L_{43}$ and $L_{44}$ of the coupling tube respectively into the first chamber and the second chamber are such that the ratio between the volume of a chamber and the length of penetration into this chamber, respectively $V_{43}/L_{43}$ and $V_{44}/L_{44}$, has a numerical value substantially ranging from 0.5 to 0.9.

* * * * *